US010227883B2

(12) United States Patent
McMahan et al.

(10) Patent No.: US 10,227,883 B2
(45) Date of Patent: Mar. 12, 2019

(54) TRANSITION DUCT ASSEMBLY

(71) Applicant: General Electric Company, Schenectady, NY (US)

(72) Inventors: Kevin Weston McMahan, Greer, SC (US); Jeffrey Scott LeBegue, Simpsonville, SC (US); James Scott Flanagan, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 321 days.

(21) Appl. No.: 15/079,083

(22) Filed: Mar. 24, 2016

(65) Prior Publication Data

US 2017/0276001 A1 Sep. 28, 2017

(51) Int. Cl.
*F01D 9/02* (2006.01)
*F01D 11/00* (2006.01)
(Continued)

(52) U.S. Cl.
CPC ..... *F01D 9/023* (2013.01); *F01D 11/003* (2013.01); *F01D 11/005* (2013.01);
(Continued)

(58) Field of Classification Search
CPC ..... F01D 9/023; F01D 11/005; F01D 11/003; F01D 25/28; F02C 7/28; F05D 2260/30; F05D 2240/55
See application file for complete search history.

(56) References Cited

U.S. PATENT DOCUMENTS 4,422,288 A 12/1983 Steber
5,077,967 A 1/1992 Widener et al.
(Continued)

FOREIGN PATENT DOCUMENTS

EP 1722069 A1 11/2006
EP 2 592 233 A1 5/2013
(Continued)

OTHER PUBLICATIONS

Steinetz, Bruce. "Effects of Compression, Staging, and Braid Angle on Braided Rope Seal Performance." Joint Propulsion Conference and Exhibit. Seattle, Washingtion. Jul. 9, 1997. retrieved from https://ntrs.nasa.gov/archive/nasa/casi.ntrs.nasa.gov/19970026182.pdf.*

(Continued)

*Primary Examiner* — Igor Kershteyn
*Assistant Examiner* — Topaz L. Elliott
(74) *Attorney, Agent, or Firm* — Dority & Manning, P.A.

(57) ABSTRACT

A turbomachine includes a plurality of transition ducts disposed in a generally annular array and including a first transition duct and a second transition duct. Each of the plurality of transition ducts includes an inlet, an outlet, and a passage extending between the inlet and the outlet and defining a longitudinal axis, a radial axis, and a tangential axis, the outlet of each of the plurality of transition ducts offset from the inlet along the longitudinal axis and the tangential axis. The turbomachine further includes a support ring assembly downstream of the plurality of transition ducts along a hot gas path, and a plurality of mechanical fasteners connecting at least one transition duct of the plurality of transition ducts to the support ring assembly.

16 Claims, 12 Drawing Sheets

(51) Int. Cl.
*F01D 25/28* (2006.01)
*F01D 25/26* (2006.01)

(52) U.S. Cl.
CPC ..... *F01D 25/265* (2013.01); *F01D 25/28* (2013.01); *F05D 2220/32* (2013.01); *F05D 2240/55* (2013.01); *F05D 2260/30* (2013.01); *F05D 2260/31* (2013.01)

(56) References Cited

U.S. PATENT DOCUMENTS 5,118,120 A 6/1992 Drerup et al.
5,249,920 A 10/1993 Shepherd et al.
5,414,999 A 5/1995 Barnes
5,419,250 A 5/1995 Ferguson
5,457,954 A 10/1995 Boyd et al.
5,592,820 A 1/1997 Alary et al.
5,706,646 A * 1/1998 Wilde ..... F01D 9/023 60/39.37
5,761,898 A 6/1998 Barnes et al.
5,839,283 A 11/1998 Dübbeling
5,934,687 A 8/1999 Bagepalli et al.
6,202,420 B1 3/2001 Zarzalis et al.
6,203,025 B1 3/2001 Hayton
6,442,946 B1 9/2002 Kraft et al.
6,471,475 B1 10/2002 Sasu et al.
6,537,023 B1 3/2003 Aksit et al.
6,564,555 B2 5/2003 Rice et al.
6,640,547 B2 11/2003 Leahy, Jr.
6,652,229 B2 11/2003 Lu
6,662,567 B1 12/2003 Jorgensen
7,007,480 B2 3/2006 Nguyen et al.
7,024,863 B2 4/2006 Morenko
7,181,914 B2 2/2007 Pidcock et al.
7,584,620 B2 * 9/2009 Weaver ..... F01D 9/023 60/39.37
7,603,863 B2 10/2009 Widener et al.
7,637,110 B2 12/2009 Czachor et al.
7,721,547 B2 * 5/2010 Bancalari ..... F01D 9/023 415/199.5
7,836,677 B2 11/2010 Bland
7,958,734 B2 6/2011 Paprotna et al.
8,065,881 B2 11/2011 Charron et al.
8,091,365 B2 1/2012 Charron
8,113,003 B2 2/2012 Charron et al.
8,186,167 B2 * 5/2012 Chila ..... F01D 9/023 415/134
8,230,688 B2 7/2012 Wilson et al.
8,276,389 B2 10/2012 Charron et al.
8,616,007 B2 12/2013 Charron
8,667,682 B2 3/2014 Lee et al.
8,707,673 B1 4/2014 Flanagan et al.
8,745,986 B2 6/2014 Melton et al.
8,826,668 B2 9/2014 Lee et al.
8,915,706 B2 12/2014 Stein et al.
8,959,888 B2 2/2015 Laster et al.
8,961,118 B2 2/2015 Charron et al.
8,978,389 B2 3/2015 Wiebe
9,090,954 B2 7/2015 Tassios et al.
9,133,722 B2 9/2015 LeBegue et al.
2008/0008584 A1 1/2008 Shteyman et al.
2009/0145137 A1 6/2009 Rizkalla et al.
2010/0037618 A1 2/2010 Charron et al.
2010/0037619 A1 2/2010 Charron
2010/0115953 A1 5/2010 Davis, Jr. et al.
2011/0056206 A1 3/2011 Wiege
2011/0067402 A1 3/2011 Wiebe et al.
2011/0259015 A1 10/2011 Johns et al.
2012/0031068 A1 2/2012 Charron
2012/0304653 A1 12/2012 Flanagan et al.
2012/0304665 A1 12/2012 LeBegue
2013/0061570 A1 3/2013 Charron et al.
2013/0081399 A1 4/2013 Wiebe
2013/0081407 A1 4/2013 Wiebe
2013/0139523 A1 6/2013 Myers et al.
2013/0174561 A1 7/2013 Stoia et al.
2013/0219853 A1 8/2013 Little et al.
2013/0219921 A1 8/2013 Wiebe et al.
2013/0224007 A1 8/2013 Rodriguez
2013/0224009 A1 8/2013 Little et al.
2013/0239585 A1 9/2013 Morrison
2014/0060000 A1 3/2014 Charron et al.
2014/0060001 A1 3/2014 Beeck
2014/0127008 A1 * 5/2014 Davi ..... F01D 9/023 415/183
2014/0260317 A1 9/2014 Charron et al.
2014/0338304 A1 11/2014 Schilp
2015/0068211 A1 3/2015 Rodriguez
2015/0082794 A1 3/2015 Schilp
2015/0107264 A1 4/2015 Wiebe et al.
2015/0132117 A1 5/2015 Marra et al.
2015/0198054 A1 7/2015 Charron et al.
2015/0204243 A1 7/2015 Charron et al.

FOREIGN PATENT DOCUMENTS

EP 2 660 427 A1 11/2013
JP WO 2017090221 A1 * 6/2017 ..... F02C 7/18

OTHER PUBLICATIONS

Hughes, et al.; U.S. Appl. No. 14/977,993, filed Dec. 22, 2015.
Hughes, et al.; U.S. Appl. No. 14/978,006, filed Dec. 22, 2015.
Hughes, et al.; U.S. Appl. No. 14/978,019, filed Dec. 22, 2015.
Extended European Search Report and Opinion issued in connection with corresponding EP Application No. 17162637.7 dated Jul. 25, 2017.

* cited by examiner

TRANSITION DUCT ASSEMBLY

FIELD OF THE DISCLOSURE

The subject matter disclosed herein relates generally to turbomachines, and more particularly to the use of transition ducts in turbomachines.

BACKGROUND OF THE DISCLOSURE

Turbomachines are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The combustor sections of turbomachines generally include tubes or ducts for flowing the combusted hot gas therethrough to the turbine section or sections. Recently, combustor sections have been introduced which include tubes or ducts that shift the flow of the hot gas. For example, ducts for combustor sections have been introduced that, while flowing the hot gas longitudinally therethrough, additionally shift the flow radially and/or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbomachine.

However, the connection and sealing of these ducts to turbine sections and to each other is of increased concern. For example, because known ducts do not simply extend along a longitudinal axis, but are rather shifted off-axis from the inlet of the duct to the outlet of the duct, thermal expansion of the ducts can cause undesirable shifts in the ducts along or about various axes. These shifts can cause stresses and strains within the ducts, and may cause the ducts to fail.

BRIEF DESCRIPTION OF THE DISCLOSURE

Aspects and advantages of the disclosure will be set forth in part in the following description, or may be obvious from the description, or may be learned through practice of the disclosure.

In one embodiment, a turbomachine is provided. The turbomachine includes a plurality of transition ducts disposed in a generally annular array and including a first transition duct and a second transition duct. Each of the plurality of transition ducts includes an inlet, an outlet, and a passage extending between the inlet and the outlet and defining a longitudinal axis, a radial axis, and a tangential axis, the outlet of each of the plurality of transition ducts offset from the inlet along the longitudinal axis and the tangential axis. The turbomachine further includes a support ring assembly downstream of the plurality of transition ducts along a hot gas path, a plurality of mechanical fasteners connecting at least one transition duct of the plurality of transition ducts to the support ring assembly, and a seal disposed between the outlet of the at least one transition duct and the support ring assembly.

In another embodiment, a turbomachine is provided. The turbomachine includes a plurality of transition ducts disposed in a generally annular array and including a first transition duct and a second transition duct. Each of the plurality of transition ducts includes an inlet, an outlet, and a passage extending between the inlet and the outlet and defining a longitudinal axis, a radial axis, and a tangential axis, the outlet of each of the plurality of transition ducts offset from the inlet along the longitudinal axis and the tangential axis. The turbomachine further includes a support ring assembly downstream of the plurality of transition ducts along a hot gas path, a plurality of mechanical fasteners connecting the first transition duct and the second transition duct to the support ring assembly, and a seal disposed between the outlet of the first transition duct and the outlet of the second transition duct.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION OF THE DISCLOSURE

Figure 1:
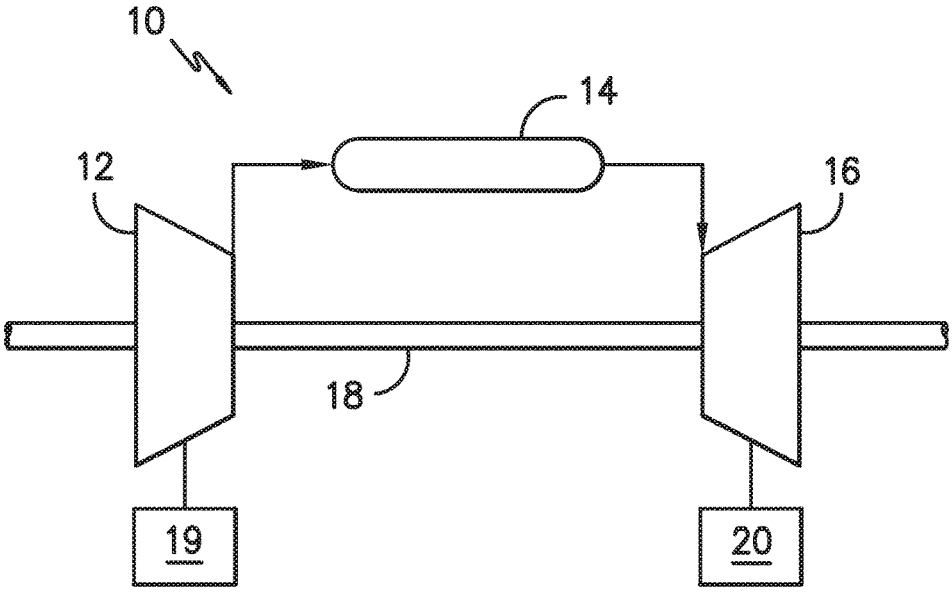
FIG. 1 is a schematic view of a gas turbine system according to embodiments of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 is a schematic diagram of a turbomachine, which in the embodiment shown is a gas turbine system 10. It should be understood that the turbomachine of the present disclosure need not be a gas turbine system 10, but rather may be any suitable turbine system or other turbomachine, such as a steam turbine system or other suitable system. The system 10 as shown may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. An inlet section 19 may provide an air flow to the compressor section 12, and exhaust gases may be exhausted from the turbine section 16 through an exhaust section 20 and exhausted and/or utilized in the system 10 or other suitable system. Exhaust gases from the system 10 may for example be exhausted into the atmosphere, flowed to a steam turbine or other suitable system, or recycled through a heat recovery steam generator.

Figure 2:
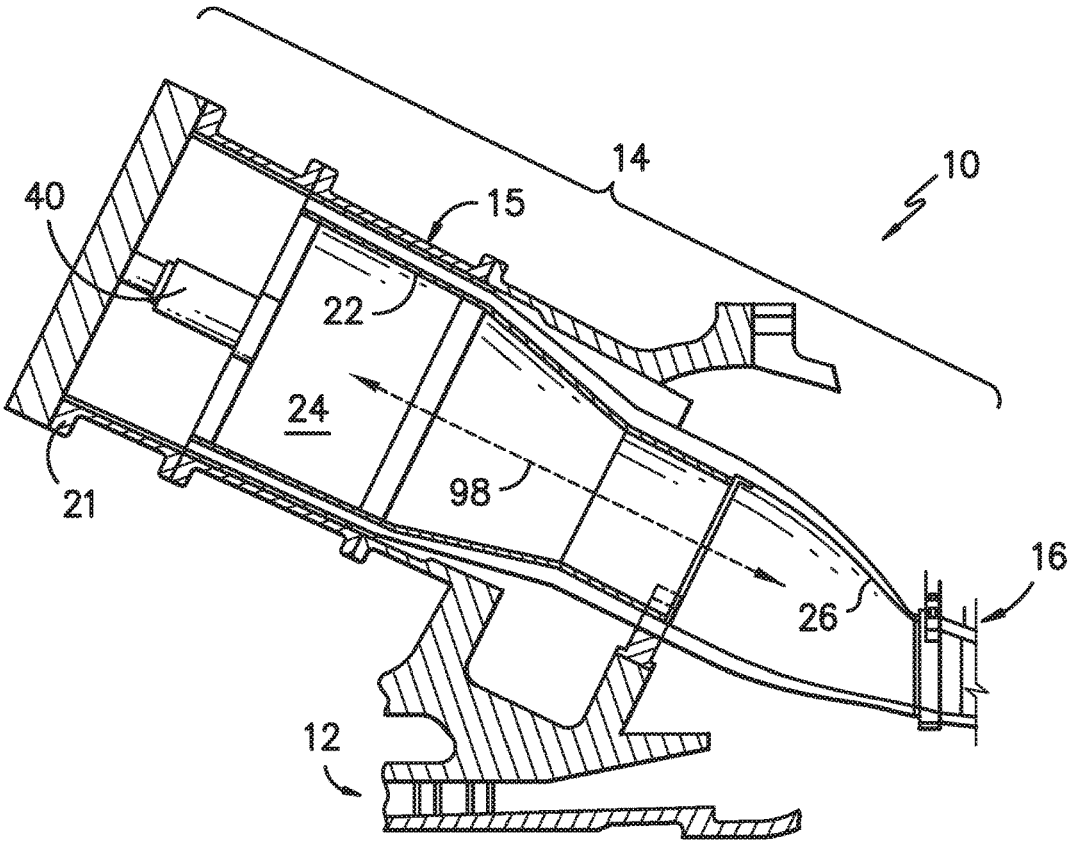
FIG. 2 is a cross-sectional view of several portions of a gas turbine system according to embodiments of the present disclosure.

Referring to FIG. 2, a simplified drawing of several portions of a gas turbine system 10 is illustrated. The gas turbine system 10 as shown in FIG. 2 includes a compressor section 12 for pressurizing a working fluid, discussed below, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

Referring now to FIGS. 4 through 13, a combustor 15 according to the present disclosure may include one or more transition ducts 50, generally referred to as a transition duct assembly. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed herein, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

Figure 4:
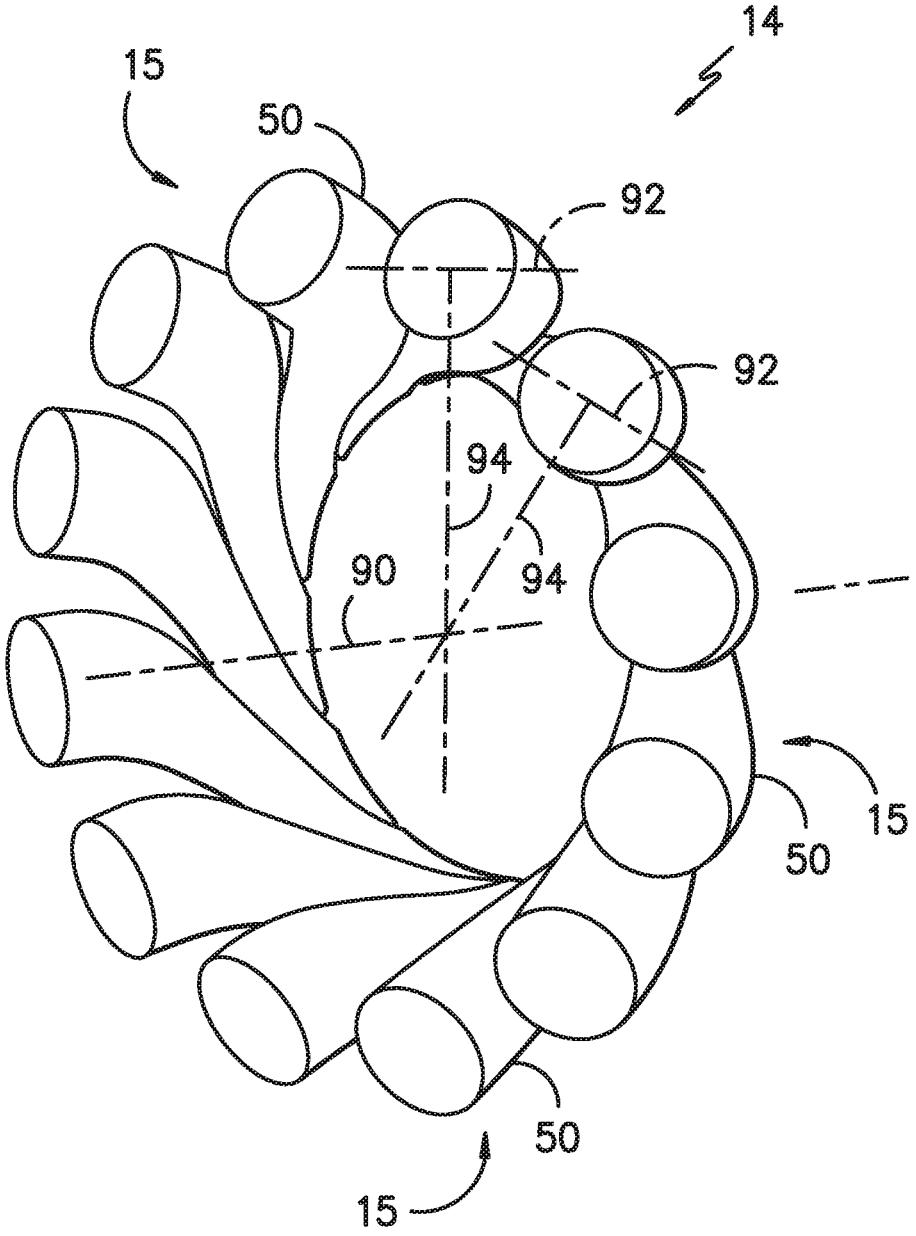
FIG. 4 is a perspective view of an annular array of transition ducts according to embodiments of the present disclosure.

It should be understood that the tangential axis 92 and the radial axis 94 are defined individually for each transition duct 50 with respect to the circumference defined by the annular array of transition ducts 50, as shown in FIG. 4, and that the axes 92 and 94 vary for each transition duct 50 about the circumference based on the number of transition ducts 50 disposed in an annular array about the longitudinal axis 90.

Figure 3:
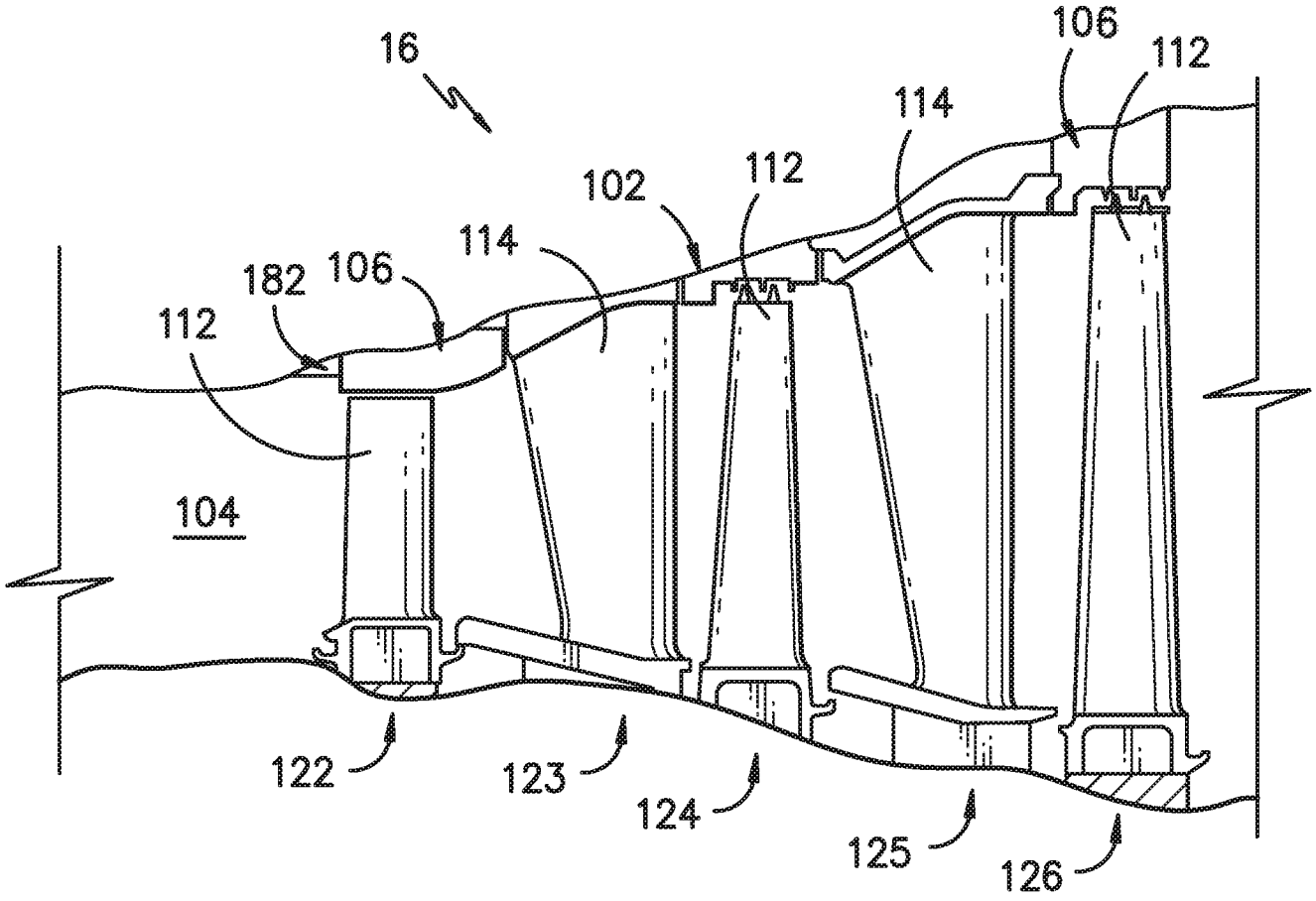
FIG. 3 is a cross-sectional view of a turbine section of a gas turbine system according to embodiments of the present disclosure.

As discussed, after hot gases of combustion are flowed through the transition duct 50, they may be flowed from the transition duct 50 into the turbine section 16. As shown in FIG. 3, a turbine section 16 according to the present disclosure may include a shroud 102, which may define a hot gas path 104. The shroud 102 may be formed from a plurality of shroud blocks 106. The shroud blocks 106 may be disposed in one or more annular arrays, each of which may define a portion of the hot gas path 104 therein. Turbine section 16 may additionally include a support ring assembly, which may include a lower support ring 180 and an upper support ring 182 and which may for example be positioned upstream (along the hot gas path 104) of the shroud 102 (such as the first plurality of shroud blocks 106 thereof) or may be a first portion of the shroud 102. The support ring assembly may further define the hot gas path 104 (i.e. between the lower and upper support rings 180, 182), and provides the transition between the transition ducts 50 and the turbine section 16. Accordingly, the support ring assembly (and support rings 180, 182 thereof) may be downstream (along the hot gas path 104) of the plurality of transition ducts 50. Hot gas may flow from the transition ducts 50 into and through the support ring assembly (between the support rings 180, 182), and from the support ring assembly through the remainder of the turbine section 16. It should be noted that the support rings may be conventionally referred to nozzle support rings or first stage nozzle support rings. However, as discussed herein, no first stage nozzles may be utilized with transition ducts 50 in accordance with exemplary embodiments of the present disclosure, and thus the support rings in exemplary embodiments do not surround any first stage or other nozzles.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 3. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 including a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Each transition duct 50 may interface with one or more adjacent transition ducts 50. For example, FIGS. 5 through 13 illustrate embodiments of a first transition duct 130 and a second transition duct 132 of the plurality of transition ducts 50. These neighboring transition ducts 130, 132 may include contact faces 134, which may be outer surfaces included in the outlets of the transition duct 50. The contact faces 134 may contact associated contact faces 134 of adjacent neighboring transition ducts 50 and/or the support ring assembly (and support rings 180, 182 thereof), as shown, to provide an interface between the transition ducts 50 and/or between the transition ducts 50 and the support ring assembly. For example, contact faces 134 of the first and second transition ducts 130, 132 may, as shown, contact each other and provide an interface between the first and second transition ducts 130, 132. Further, contact faces 134 of the first and second transition ducts 130, 132 may, as shown, contact the support ring assembly and provide an interface between the transition ducts 130, 132 and the support ring assembly. As discussed herein, seals may be provided between the various contact faces to facilitate sealing at such interfaces. Notably, contact as discussed herein may include direct contact between the components themselves or indirect component through seals disposed between the components.

Figure 7:
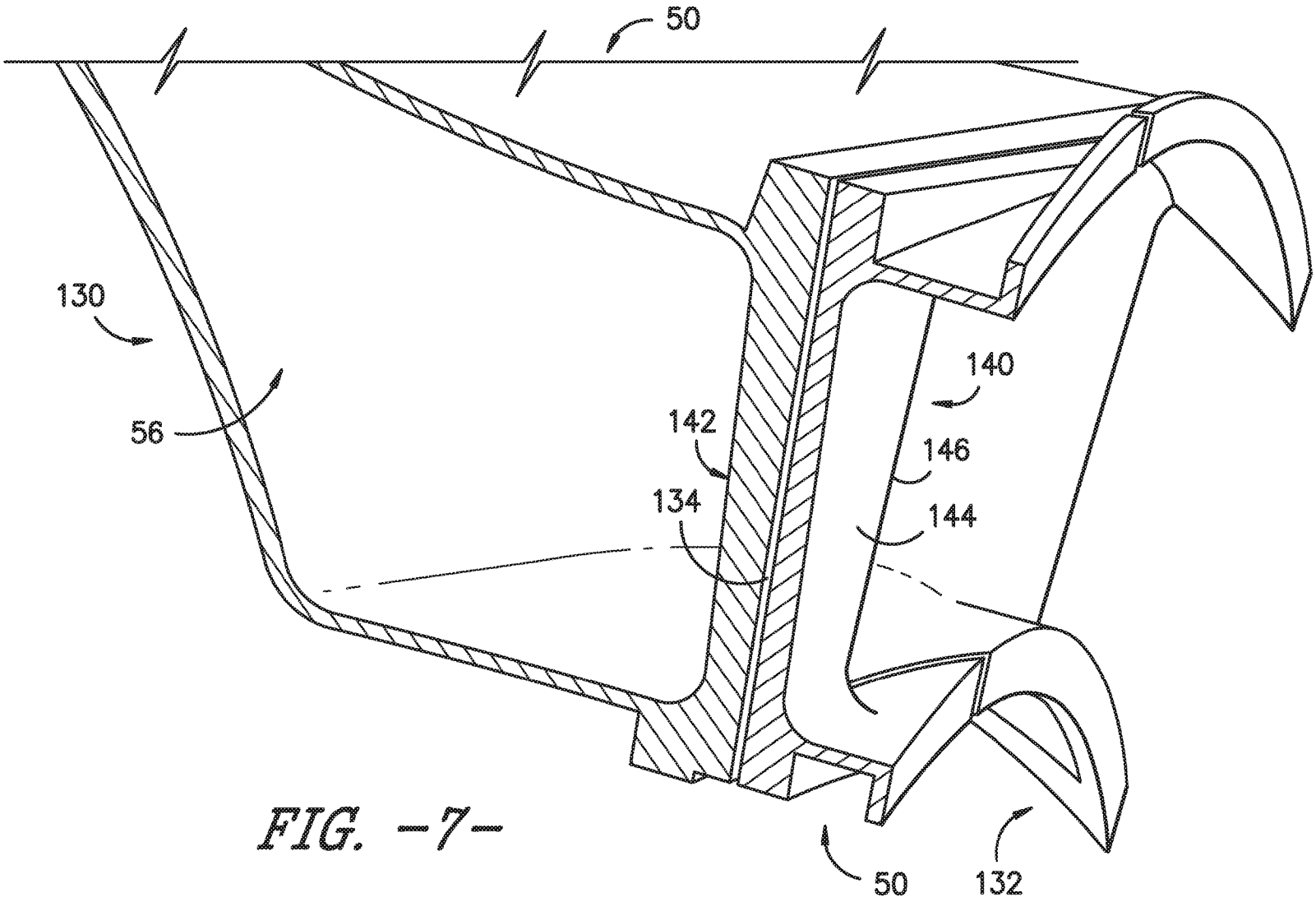
FIG. 7 is a cutaway perspective view of a transition duct assembly, including neighboring transition ducts and forming various portions of an airfoil therebetween according to embodiments of the present disclosure.
Figure 8:
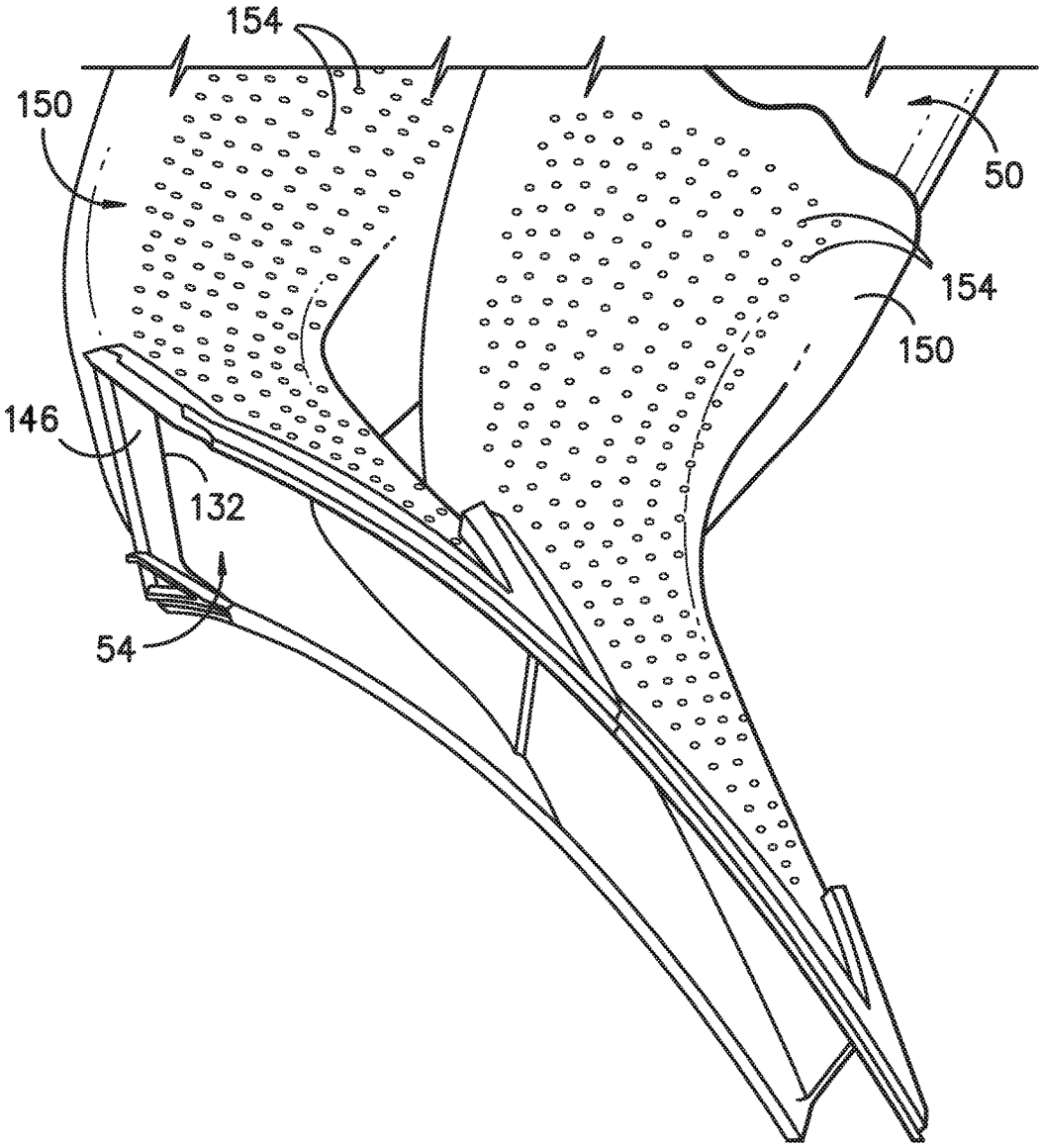
FIG. 8 is a top front perspective view of a plurality of transition ducts and associated impingement sleeves according to embodiments of the present disclosure.
Figure 11:
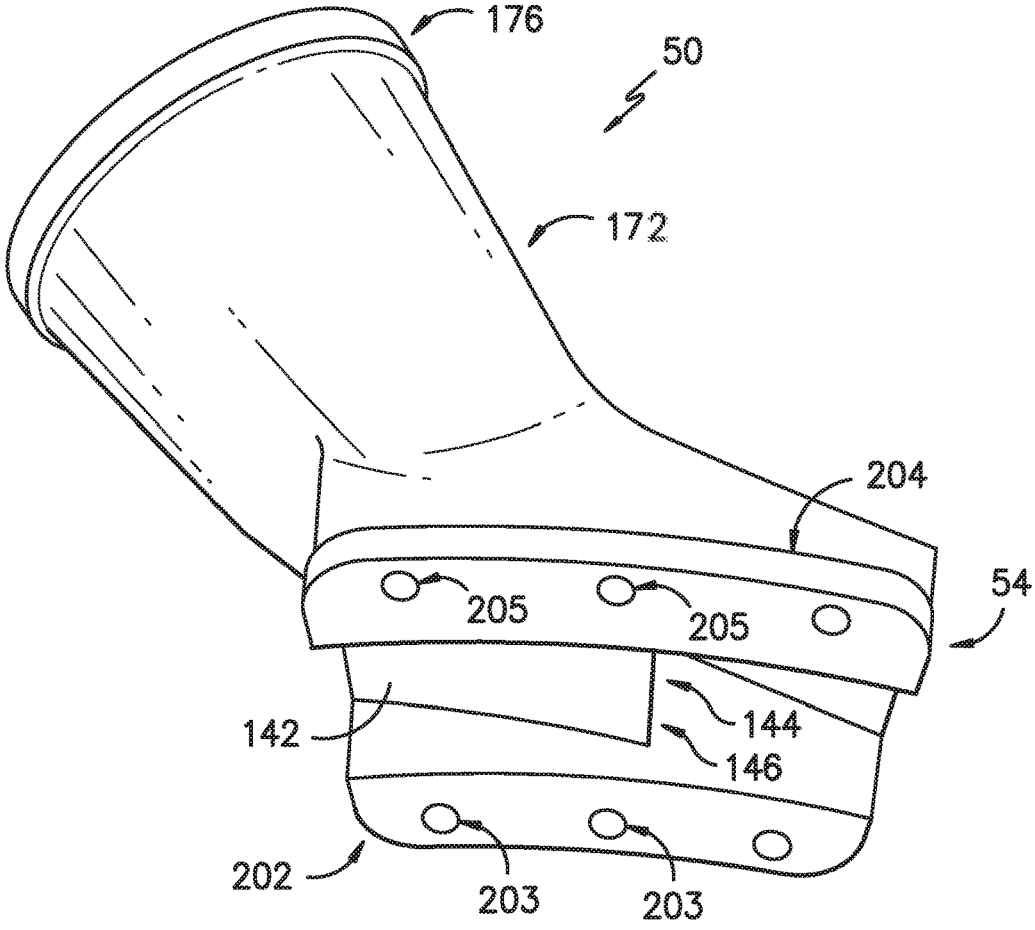
FIG. 11 is a front perspective view of a downstream portion of a transition duct according to embodiments of the present disclosure.
Figure 12:
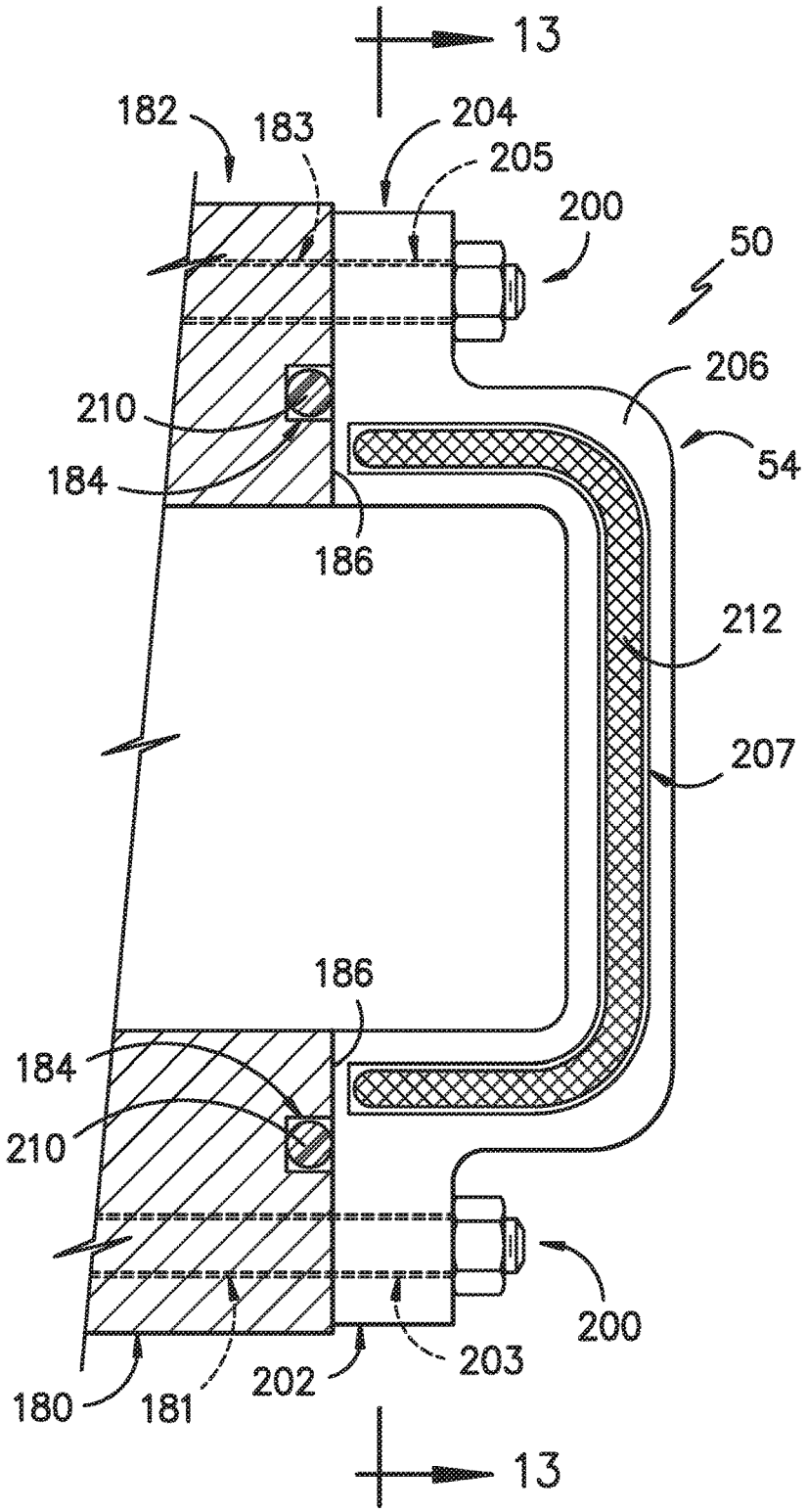
FIG. 12 is a cross-sectional view of a transition duct connected to a support ring assembly according to embodiments of the present disclosure.
Figure 13:
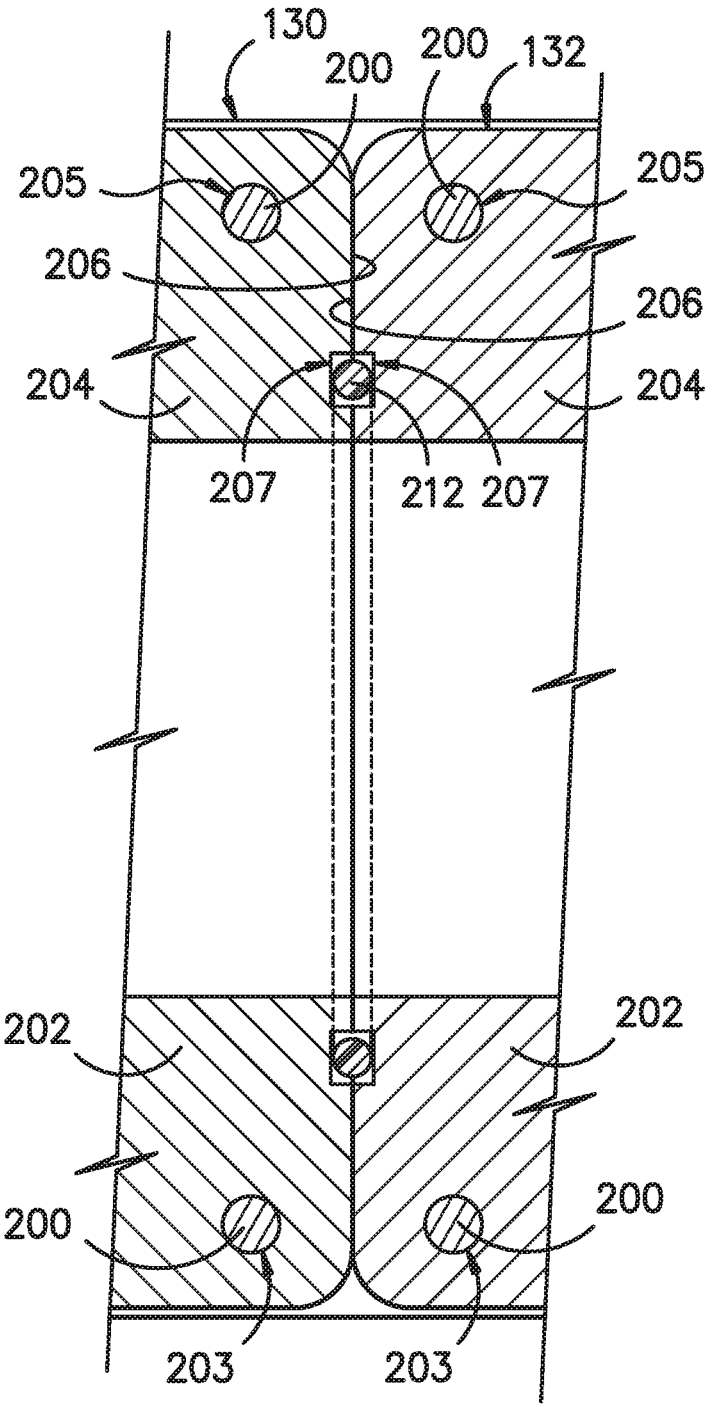
FIG. 13 is a cross-sectional view of outlets of neighboring transition ducts according to embodiments of the present disclosure.

Further, the transition ducts 50, such as the first and second transition ducts 130, 132, may form aerodynamic structures 140 having various aerodynamic surfaces of an airfoil. Such aerodynamic structure 140 may, for example, be defined by inner surfaces of the passages 56 of the transition ducts 50, and further may be formed when contact faces 134 of adjacent transition ducts 50 interface with each other. These various surfaces may shift the hot gas flow in the transition ducts 50, and thus eliminate the need for first stage nozzles, as discussed herein. For example, in some embodiments as illustrated in FIGS. 7 and 8, an inner surface of a passage 56 of a transition duct 50, such as a first transition duct 130, may define a pressure side 142, while an opposing inner surface of a passage 56 of an adjacent transition duct 50, such as a second transition duct 132, may define a suction side 144. When the adjacent transition ducts 50, such as the contact faces 134 thereof, interface with each other, the pressure side 142 and suction side 144 may combine to define a trailing edge 146. In other embodiments, as illustrated in FIG. 11, inner surfaces of a passage 56 of a transition duct 50, such as a first transition duct 130, may define a pressure side 142 and a suction side 144 as well as a trailing edge therebetween. Inner surfaces of a passage 56 of a neighboring transition duct 50, such as a second transition duct 132, may further define the pressure side 142 and/or the suction side 144.

Figure 5:
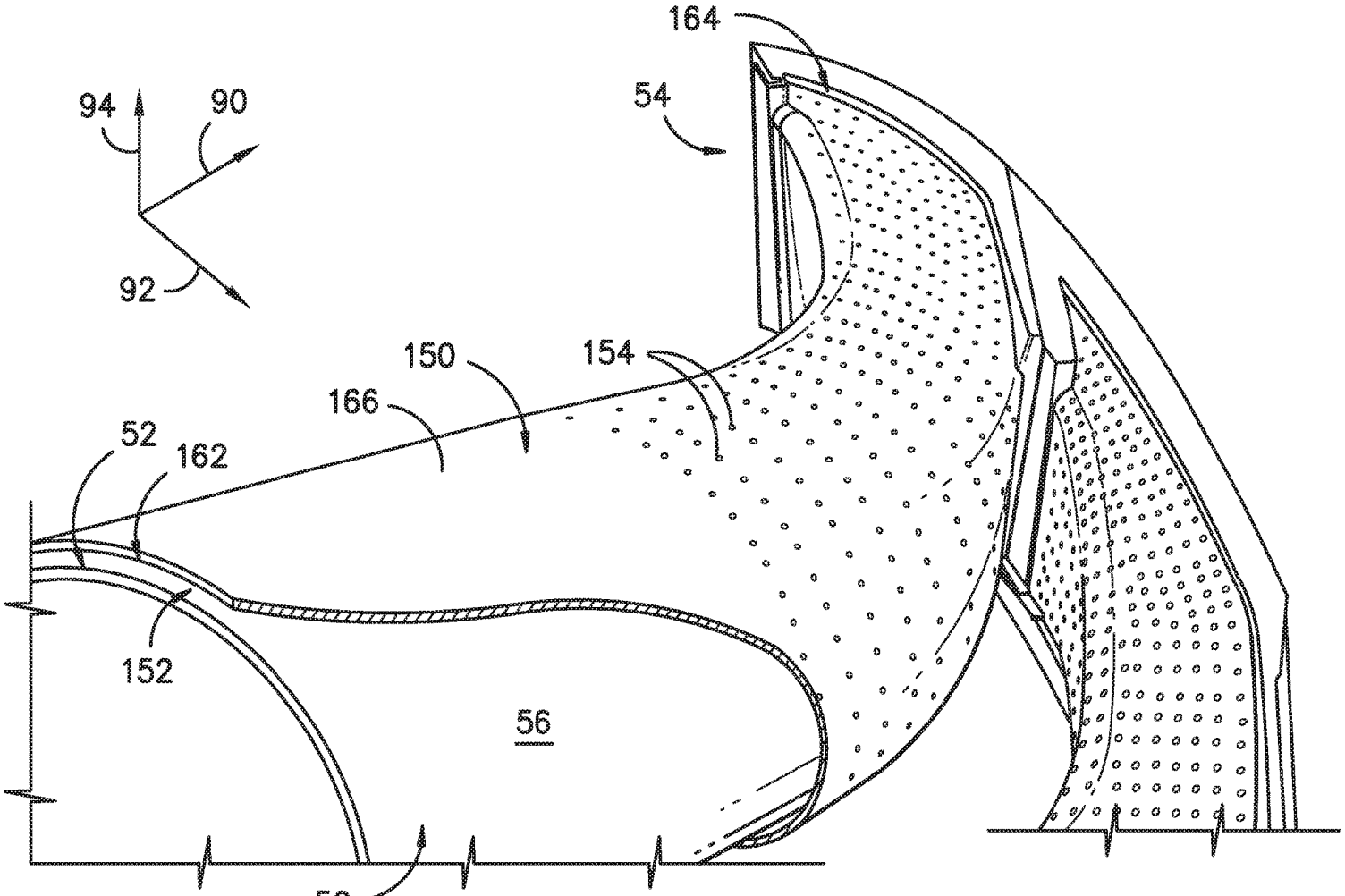
FIG. 5 is a top perspective view of a plurality of transition ducts and associated impingement sleeves according to embodiments of the present disclosure.
Figure 6:
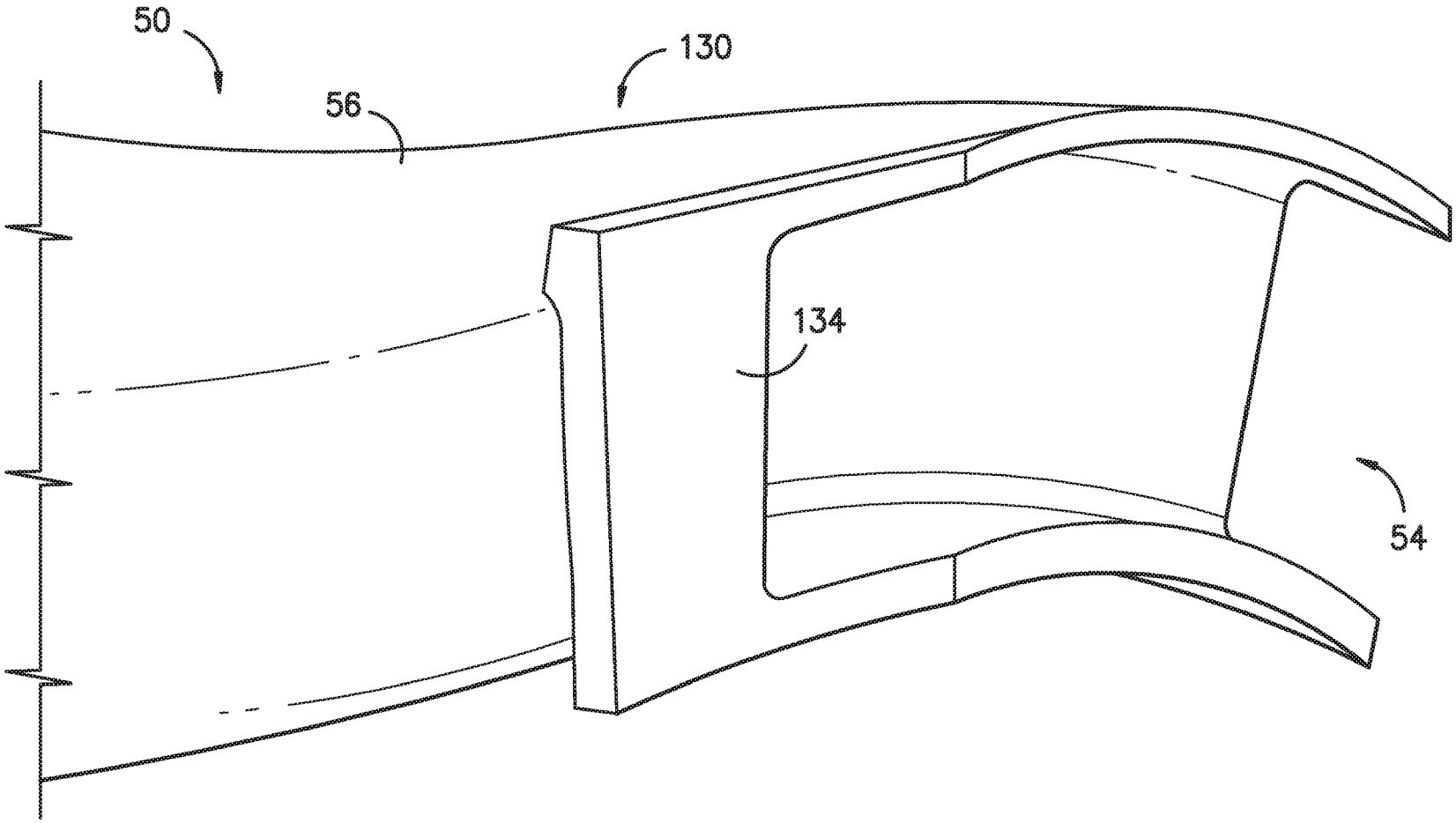
FIG. 6 is a side perspective view of a transition duct according to embodiments of the present disclosure.

As shown in FIGS. 5 and 8, in exemplary embodiments, flow sleeves 150 may circumferentially surround at least a portion of the transition ducts 50. A flow sleeve 150 circumferentially surrounding a transition duct 50 may define an annular passage 152 therebetween. Compressed working fluid from the casing 21 may flow through the annular passage 152 to provide convective cooling to transition duct 50 before reversing direction to flow through the fuel nozzles 40 and into the transition duct 50. Further, in some embodiments, the flow sleeve 150 may be an impingement sleeve. In these embodiments, impingement holes 154 may be defined in the sleeve 150, as shown. Compressed working fluid from the casing 21 may flow through the impingement holes 154 and impinge on the transition duct 50 before flowing through the annular passage 152, thus providing additional impingement cooling of the transition duct.

Each flow sleeve 150 may have an inlet 162, an outlet 164, and a passage 166 therebetween. Each flow sleeve 150 may extend between a fuel nozzle 40 or plurality of fuel nozzles 40 and the turbine section 16, thus surrounding at least a portion of the associated transition duct 50. Thus, similar to the transition ducts 50, as discussed above, the outlet 164 of each of the plurality of flow sleeves 150 may be longitudinally, radially, and/or tangentially offset from the inlet 162 of the respective flow sleeve 150.

Figure 9:
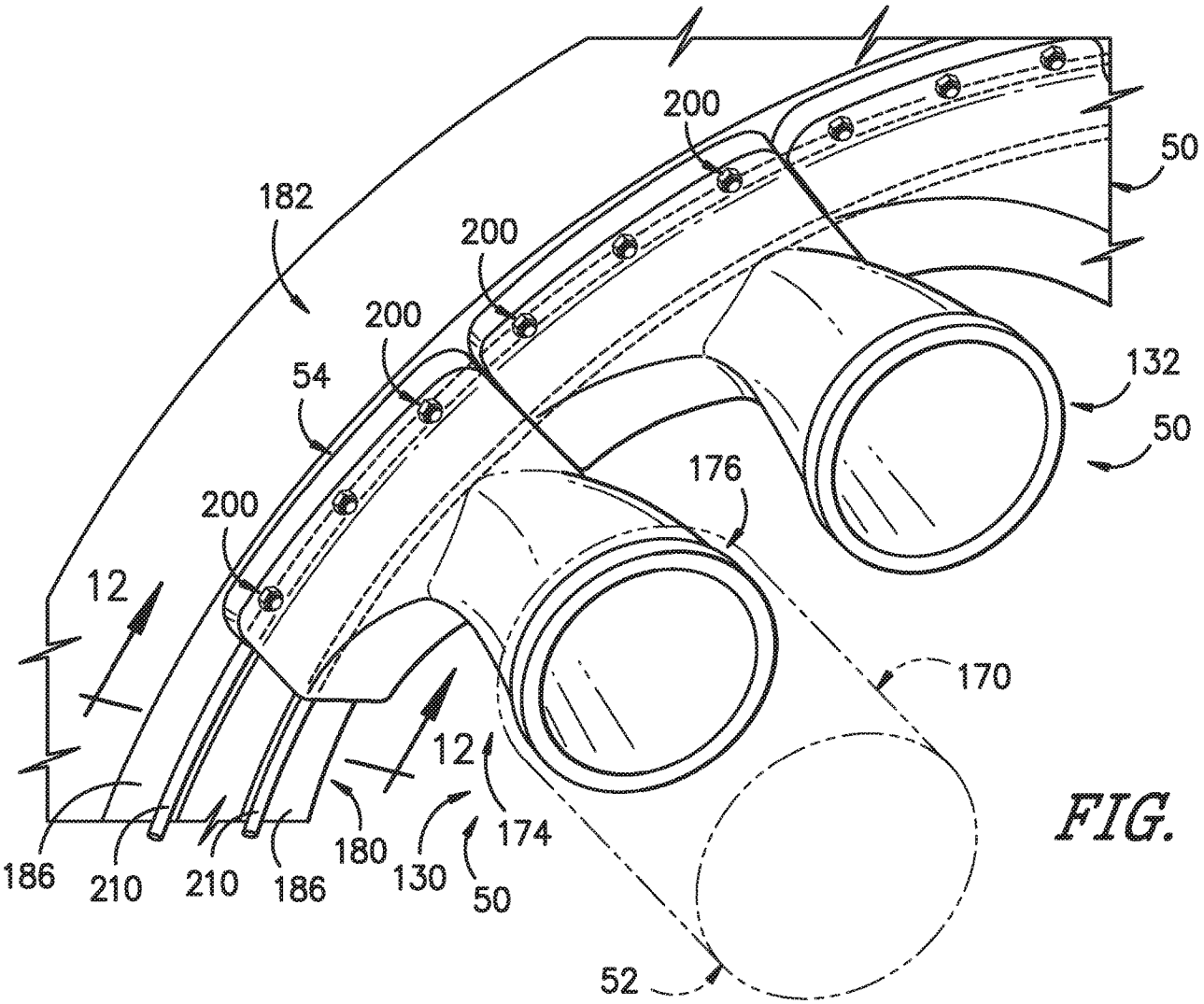
FIG. 9 is a top rear perspective view of a plurality of transition ducts connected to a support ring assembly according to embodiments of the present disclosure.
Figure 10:
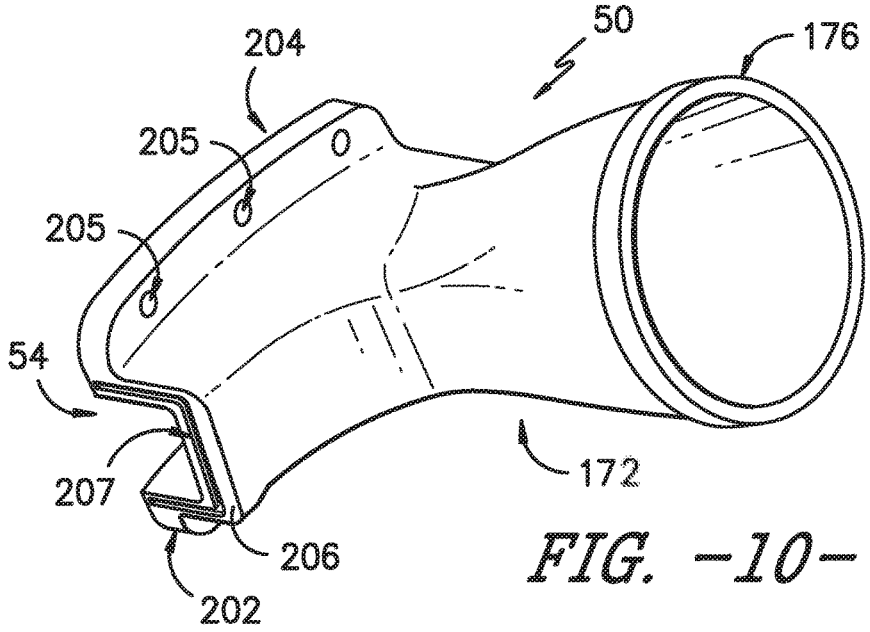
FIG. 10 is a side perspective view of a downstream portion of a transition duct according to embodiments of the present disclosure.

In some embodiments, as illustrated in FIGS. 5 and 8, a transition duct 50 according to the present disclosure is a single, unitary component extending between the inlet 52 and the outlet 54. In other embodiments, as illustrated in FIGS. 9 through 11, a transition duct 50 according to the present disclosure may include a plurality of sections or portions, which are articulated with respect to each other. This articulation of the transition duct 50 may allow the various portions of the transition duct 50 to move and shift relative to each other during operation, allowing for and accommodating thermal growth thereof. For example, a transition duct 50 may include an upstream portion 170 and a downstream portion 172. The upstream portion 170 may include the inlet 52 of the transition duct 50, and may extend generally downstream therefrom towards the outlet 54. The downstream portion 172 may include the outlet 54 of the transition duct 50, and may extend generally upstream therefrom towards the inlet 52. The upstream portion 170 may thus include and extend between the inlet 52 and an aft end 174, and the downstream portion 172 may include and extend between a head end 176 and the outlet 54.

A joint may couple the upstream portion 170 and downstream portion 172 together, and may provide the articulation between the upstream portion 170 and downstream portion 172 that allows the transition duct 50 to move during operation of the turbomachine. Specifically, the joint may couple the aft end 174 and the head end 176 together. The joint may be configured to allow movement of the upstream portion 170 and/or the downstream portion 172 relative to one another about or along at least one axis. Further, in some embodiments, the joint may be configured to allow such movement about or along at least two axes, such as about or along three axes. The axis or axes can be any one or more of the longitudinal axis 90, the tangential axis 92, and/or the radial axis 94. Movement about one of these axes may thus mean that one of the upstream portion 170 and/or the downstream portion 172 (or both) can rotate or otherwise move about the axis with respect to the other due to the joint providing this degree of freedom between the upstream portion 170 and downstream portion 172. Movement along one of these axes may thus mean that one of the upstream portion 170 or the downstream portion 172 (or both) can translate or otherwise move along the axis with respect to the other due to the joint providing this degree of freedom between the upstream portion 170 and downstream portion 172. In exemplary embodiments the joint may be a hula seal. Alternatively, other suitable seals or other joints may be utilized.

In some embodiments, use of an upstream portion 170 and downstream portion 172 can advantageously allow specific materials to be utilized for these portions. For example, the downstream portions 172 can advantageously be formed from ceramic materials, such as ceramic matrix composites. The upstream portions 170 and flow sleeves 150 can be formed from suitable metals. Use of ceramic materials is particularly advantageous due to their relatively higher temperature tolerances. Ceramic material can in particular be advantageously utilized for downstream portions 172 when the downstream portions 172 are connected to the support ring assembly (as discussed herein) and the upstream portions 170 can move relative to the downstream portions 172, as movement of the downstream portions 172 is minimized, thus lessening concerns about using relatively brittle ceramic materials.

In some embodiments, the interface between the transition ducts 50, such as the outlets 54 thereof, and the support ring assembly (and support rings 180, 182 thereof) may be a floating interface. For example, the outlets 54 may not be connected to the support rings 180, 182 and may be allowed to move relative to the support rings 180, 182. This may allow for thermal growth of the transition ducts 50 during operation. Suitable floating seals, which can accommodate such movement, may be disposed between the outlets 54 and the support rings 180, 182. Alternatively, and referring now to FIGS. 9 through 14, in some embodiments, the interface between the transition ducts 50, such as the outlets 54 thereof, and the support rings 180, 182 may be a connected interface. In exemplary embodiments, for example, connected interfaces may be utilized with articulated transition ducts that include upstream and downstream portions 170, 172.

For example, as illustrated, a plurality of mechanical fasteners 200 may be provided. The mechanical fasteners 200 may connect one or more of the transition ducts 50 (such as the outlets 54 thereof), including for example the first and/or second transition ducts 130, 132, to the support ring assembly (and support rings 180, 182 thereof). In exemplary embodiments as illustrated, a mechanical fastener 200 in accordance with the present disclosure includes a bolt, and may for example be a nut/bolt combination. In alternative embodiments, a mechanical fastener in accordance with the present disclosure may be or include a screw, nail, rivet, etc.

As illustrated mechanical fasteners 200 may extend through portions of the transition ducts 50 (such as the outlets 54 thereof) and support ring assembly (and support rings 180, 182 thereof) to connect these components together. The outlet 54 of a transition duct 50 may, for example, include an inner flange 202 and/or outer flange 204 (which may be/define contact faces 134 of the transition duct 50). The inner flange 202 may be disposed radially inward of the outer flange 204, and an opening of the outlet 54 through which hot gas flows from the transition duct 50 into and through the support ring assembly (between the support rings 180, 182) may be defined between the inner flange 202 and the outer flange 204. Bore holes 203, 205 may be defined in the inner 202 and outer flanges 204, respectively. The bore holes 203, 205 may align with bore holes 181, 183 defined in the support rings 180, 182, and mechanical fasteners 200 may extend through each bore hole 203, 205 and mating bore hole 181, 183 to connect the flange 202, 204 and support rings 180, 182 together.

Referring in particular to FIGS. 9 and 12-14, one or more seals 210 (which may be referred to as first seals 210) may be disposed between one or more of the transition ducts 50 (such as the outlets 54 thereof) and the support ring assembly (and support rings 180, 182 thereof). For example, a seal 210 may be disposed between the inner flange 202 and the inner support ring 180 and/or between the outer flange 204 and the outer support ring 182. In exemplary embodiments, a seal 210 may be disposed between more than one transition duct 50 and the support ring(s) 180, 182. For example, a seal 210 may be disposed between the entire plurality of transition ducts 50 and the support ring 180 and/or support ring 182. The seal 210 may be an annular seal 210 which extends around substantially the entire ring shape of the support ring 180, 182. Alternatively, a seal 210 may extend between a support ring 180, 182 and one transition duct 50 or a portion of the plurality of transition ducts 50.

In exemplary embodiments, one or more channels 184 may be defined in the support ring assembly (such as the support ring 180 and/or support ring 182), such as in a contact face 186 thereof. One or more seals 210 may be at least partially disposed within channels 184. In some embodiments, a channel 184 may an annular channel 184. Alternatively, a channel 184 may be arc-shaped, linear, or have any other suitable shape. Additionally or alternatively, one or more channels may be defined in the transition ducts 50, such as in the inner flanges 202 and/or outer flanges 204 (and particularly in the contact faces 134 thereof). Seals 210 may additionally or alternatively be at least partially disposed within these channels.

Additionally or alternatively, one or more seals 212 (which may be referred to as second seals 212) may be disposed between neighboring transition ducts 50 of the plurality of transition ducts 50, such as between the first transition duct 130 and second transition duct 132. In particular, seals 212 may be provided between the outlets 54 of neighboring transition ducts 50, such as between the outlet 54 of the first transition duct 130 and the outlet 54 of the second transition duct 132. For example, an outlet 54 of a transition duct 50 may further include an edge surface 206 (which may be/define contact faces 134 of the transition duct 50) which further define the outlet 54 and an opening thereof. One or more seals 212 may be defined between the edge surfaces 206 of neighboring transition ducts 50, such as the first transition duct 130 and second transition duct 132.

In some embodiments, one or more channels 207 may be defined in the edge surfaces 206 of neighboring transition ducts 50. One or more seals 212 may be at least partially disposed within channels 207. A seal 212 may be at least partially disposed within channels 207 of both neighboring transition ducts 50 between which the seal 212 is providing a sealed interface, or only one of the neighboring transition ducts 50 between which the seal 212 is providing a sealed interface may include a channel 207.

Figure 14:
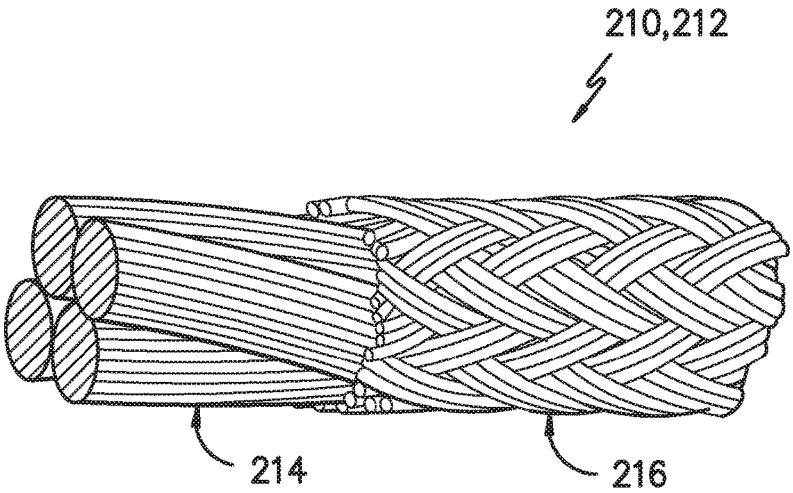
FIG. 14 illustrates a seal according to embodiments of the present disclosure.

In some embodiments, as illustrated in FIG. 14, first seals 210 and/or second seals 212 in accordance with the present disclosure may be a metallic rope seal. A metallic rope seal, as illustrated, includes a core 214 and an outer layer 216 surrounding the core 214. Core 214 may be formed from, for example, a plurality of bundled or twisted fiber strands. Metallic or ceramic fibers may, for example, be utilized for the core 214. Outer layer 216 may include a plurality of woven or braided fiber strands. Metallic fibers may, for example, be utilized. Metallic rope seals are particularly desirable in embodiments wherein the transition ducts 50 (such as the downstream portions 172 thereof) are connected to the support ring assembly (and support rings 180, 182 thereof), due to the relatively minimal relative movement between the transition ducts 50 (such as the downstream portions 172 thereof) and the support ring assembly and between the neighboring transition ducts 50 (such as the downstream portions 172 thereof).

Alternatively, other suitable seals may be utilized. For example, in some embodiments, flexible metallic seals may be utilized. In some embodiments, convolution seals may be utilized. A convolution seal has one or more folds or curves which defining various legs that facilitate sealing. The seal may be formed from a metal or metal alloy, or from any other suitable material. The convolutions in the seal may allow the various legs of the seal to flex relative to one another to facilitate sealing. In some embodiments, leaf seals may be utilized.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbomachine, comprising:

a plurality of transition ducts disposed in a generally annular array and comprising a first transition duct and a second transition duct, each of the plurality of transition ducts comprising an inlet, an outlet, a channel defined in an edge surface of the outlet, and a passage extending between the inlet and the outlet and defining a longitudinal axis, a radial axis, and a tangential axis, the outlet of each of the plurality of transition ducts offset from the inlet along the longitudinal axis and the tangential axis;

a support ring assembly downstream of the plurality of transition ducts along a hot gas path, the support ring assembly comprising a contact face and a channel defined in the contact face;

a plurality of mechanical fasteners connecting at least one transition duct of the plurality of transition ducts to the support ring assembly;

a first seal disposed between the outlet of the at least one transition duct and the support ring assembly, the first seal at least partially disposed within the channel defined in the contact face of the support ring assembly; and a second seal disposed between the outlet of the first transition duct and the outlet of the second transition duct, the second seal at least partially disposed within the channels of the outlet of the first transition duct and the outlet of the second transition duct.

2. The turbomachine of claim 1, wherein at least one of the first seal and the second seal is a metallic rope seal.

3. The turbomachine of claim 1, wherein the outlet of the at least one transition duct comprises an outer flange and an inner flange, and wherein the plurality of mechanical fasteners connect the outer flange and inner flange to the support ring assembly.

4. The turbomachine of claim 3, wherein the first seal is disposed between one of the outer flange and the support ring assembly or the inner flange and the support ring assembly.

5. The turbomachine of claim 4, wherein the first seal is a plurality of first seals, and wherein one of the plurality of first seals is disposed between the outer flange and the support ring assembly and another of the plurality of seals is disposed between the inner flange and the support ring assembly.

6. The turbomachine of claim 1, wherein the plurality of mechanical fasteners connect the first transition duct and the second transition duct to the support ring assembly.

7. The turbomachine of claim 1, wherein the passage of the at least one transition duct comprises an upstream portion and a downstream portion, the upstream portion extending between the inlet and an aft end, the downstream portion between a head end and the outlet.

8. The turbomachine of claim 1, wherein each of the plurality of mechanical fasteners comprises a bolt.

9. The turbomachine of claim 1, wherein the outlet of each of the plurality of transition ducts is further offset from the inlet along the radial axis.

10. The turbomachine of claim 1, further comprising a turbine section in communication with plurality of transition ducts, the turbine section comprising the support ring assembly and a first stage bucket assembly.

11. The turbomachine of claim 10, wherein no nozzles are disposed upstream of the first stage bucket assembly.

12. A turbomachine, comprising:

a plurality of transition ducts disposed in a generally annular array and comprising a first transition duct and a second transition duct, each of the plurality of transition ducts comprising an inlet, an outlet, a channel defined in an edge surface of the outlet, and a passage extending between the inlet and the outlet and defining a longitudinal axis, a radial axis, and a tangential axis, the outlet of each of the plurality of transition ducts offset from the inlet along the longitudinal axis and the tangential axis;

a support ring assembly downstream of the plurality of transition ducts along a hot gas path, the support ring assembly comprising a contact face and a channel defined in the contact face;

a plurality of mechanical fasteners connecting the first transition duct and the second transition duct to the support ring assembly;

a first seal disposed between the outlet of the first transition duct and the outlet of the second transition duct, the first seal at least partially disposed within the channel defined in the contact face of the support ring assembly; and a second seal disposed between the outlet of the first transition duct and the outlet of the second transition duct, the second seal at least partially disposed within the channels of the outlet of the first transition duct and the outlet of the second transition duct.

13. The turbomachine of claim 12, wherein at least one of the first seal and the second seal is a metallic rope seal.

14. The turbomachine of claim 12, wherein each of the plurality of mechanical fasteners comprises a bolt.

15. The turbomachine of claim 12, wherein the outlet of each of the plurality of transition ducts is further offset from the inlet along the radial axis.

16. The turbomachine of claim 12, further comprising a turbine section in communication with plurality of transition ducts, the turbine section comprising the support ring and a first stage bucket assembly, and wherein no nozzles are disposed upstream of the first stage bucket assembly.

* * * * *